US009765549B2

(12) United States Patent
Shah et al.

(10) Patent No.: US 9,765,549 B2
(45) Date of Patent: Sep. 19, 2017

(54) UNIVERSAL LATCH HANDLE

(75) Inventors: Kirti Shah, South Barrington, IL (US); Darryl Devine, Huntley, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 25 days.

(21) Appl. No.: 13/347,433

(22) Filed: Jan. 10, 2012

(65) Prior Publication Data

US 2013/0076046 A1 Mar. 28, 2013

Related U.S. Application Data

(60) Provisional application No. 61/538,512, filed on Sep. 23, 2011.

(51) Int. Cl.

| | |
|---|---|
| ***E05B 3/10*** | (2006.01) |
| ***E05B 63/00*** | (2006.01) |
| ***E05C 1/14*** | (2006.01) |
| ***E05B 1/00*** | (2006.01) |
| ***E05B 7/00*** | (2006.01) |

(52) U.S. Cl.

CPC ..... *E05B 63/0056* (2013.01); *E05B 1/0053* (2013.01); *E05B 7/00* (2013.01); *E05C 1/14* (2013.01); *Y10T 292/57* (2015.04)

(58) Field of Classification Search

CPC .... E05B 63/0056; E05B 85/16; E05B 1/0053; E05B 7/00; E05C 1/14; Y10T 292/57

USPC ..... 292/336.3, 1, 137, 92, 93, 94, 347, 348, 292/DIG. 60, DIG. 53, DIG. 54, 163, 164, 292/165, 170, 169, 138, 140, 111, 124, 292/197, 215, 224

See application file for complete search history.

(56) References Cited

U.S. PATENT DOCUMENTS

| | | | | | |
|---|---|---|---|---|---|
| 1,463,384 | A | * | 7/1923 | Butterworth | E05B 15/025 292/341.18 |
| 1,563,667 | A | * | 12/1925 | Smith | E05B 15/025 292/341.18 |
| D230,945 | S | | 3/1974 | Beckman | |
| 4,007,954 | A | * | 2/1977 | Erickson | A62C 2/242 292/165 |
| 4,629,228 | A | * | 12/1986 | Marko | E05B 7/00 292/165 |
| 4,818,003 | A | | 4/1989 | Seko et al. | |
| 4,887,854 | A | * | 12/1989 | Bulten | E05C 3/14 292/104 |
| 4,986,583 | A | * | 1/1991 | Campbell | E05B 65/104 292/165 |
| 5,072,977 | A | * | 12/1991 | Millman | E05B 63/04 292/172 |
| 5,085,474 | A | * | 2/1992 | Toledo | E05C 1/14 292/244 |

(Continued)

*Primary Examiner* — Nathan Cumar

(74) *Attorney, Agent, or Firm* — Greer, Burns & Crain, Ltd.

(57) ABSTRACT

A door handle assembly for use with a door is provided with a base plate, a door handle having a working end pivotally connected to the base plate and a free end opposite of the working end configured for manipulation by an operator. An adapter plate mounted on the working end of the door handle and a cam lever are also included in the present door handle assembly. A securable end of the cam lever is affixable to the adapter plate, and a free end of the cam lever is configured for engagement with a cam, for activating a door latch assembly.

15 Claims, 13 Drawing Sheets

(56) References Cited

U.S. PATENT DOCUMENTS

| | | | | |
|---|---|---|---|---|
| 5,730,478 | A | 3/1998 | D'Hooge | |
| 6,000,254 | A * | 12/1999 | Raybary | E05B 37/163 70/133 |
| D419,053 | S | 1/2000 | Schlack | |
| 6,109,669 | A | 8/2000 | Pinkow | |
| 6,196,599 | B1 * | 3/2001 | D'Hooge | E05B 7/00 292/165 |
| 6,293,598 | B1 * | 9/2001 | Rusiana | E05B 7/00 292/143 |
| D465,142 | S | 11/2002 | Weinerman et al. | |
| D465,399 | S | 11/2002 | Weinerman et al. | |
| D502,380 | S | 3/2005 | Misner et al. | |
| D505,310 | S | 5/2005 | Lorusso | |
| D533,045 | S | 12/2006 | Schroth | |
| D537,321 | S | 2/2007 | Paige et al. | |
| D541,129 | S | 4/2007 | Helton et al. | |
| 7,258,374 | B2 | 8/2007 | Rusiana | |
| D577,984 | S | 10/2008 | Samhammer et al. | |
| 7,481,607 | B2 | 1/2009 | Rusiana et al. | |
| D646,548 | S | 10/2011 | Mussi et al. | |
| D646,549 | S | 10/2011 | Mussi et al. | |
| 2006/0028027 | A1 * | 2/2006 | Schlack | E05B 1/0092 292/75 |
| 2006/0261608 | A1 * | 11/2006 | Rusiana | E05C 1/14 292/336.3 |

* cited by examiner

UNIVERSAL LATCH HANDLE

RELATED APPLICATION

This application claims priority pursuant to 35 USC 119(e) from U.S. Provisional Application Ser. No. 61/538,512 filed Sep. 23, 2011.

BACKGROUND

The present invention relates generally to push/pull type door latch assemblies that include paddle style handles that are selectively positionable in either in up, down, horizontal left or horizontal right configurations. More specifically, the present latch assembly is applicable to centered or off-set latch assembly configurations.

Door latches keep a door from opening until an operator disengages the door latch bolt by maneuvering one of the handles. Rotating knob, lever, and push/pull paddle type door handles are known in the art. Because no rotational movement is required to operate push/pull door handles, they are commonly used in health care and education facilities such as hospitals, nursing homes and schools. One desirable feature of push/pull door handle and latch assemblies is that easy, hands-free opening of a door is possible.

Examples of existing push/pull door latch assemblies are described in U.S. Pat. Nos. 6,293,598; 7,258,374; 7,481,607; 6,196,599 and 5,730,478, all commonly assigned to Architectural Builders Hardware Manufacturing, Inc., and hereby incorporated by reference. Such door latch assemblies include, generally, a latching mechanism, at least one handle assembly and at least one cam assembly.

Latching mechanisms or assemblies conventionally include locking bolts, levers, springs, cylinders, and drive shafts. Handle assemblies conventionally include base plates, paddle style handle levers, springs, pins and fasteners. A known paddle style push/pull handle assembly, disclosed in U.S. Pat. No. 5,730,478 is described as one continuous piece pivoting around a fulcrum. One part of the handle assembly is visible to an operator and is commonly known as the handle, while the other part is not generally visible when assembled, but extends into the inner mechanism of the latch assembly and operates as an actuator of a cam assembly that is responsible for engagement with, and actuation of a locking bolt or latch.

In conventional applications, a pull handle of a door latch assembly is mounted on the side of the door toward which the door opens into a room interior, and a push handle of the door latch assembly is mounted on the opposite side of the door. These assemblies typically incorporate a cam which transfers motion from the pushing or pulling movement of the handle to rotate a drive shaft extending through an opening in a latch cylinder. When rotated, the drive shaft withdraws the door latch, against the force of a return spring, to release the door. Generally, only a small amount of force in one direction is sufficient to release the latch.

Often times, conventional knob or lever door handle and latch assemblies are converted to push/pull type door handle and latch assemblies. As such, push/pull handles are designed to be adaptable to a variety of conventional latch configurations. However, there are still several types of latch configurations which are incompatible with push/pull handle assemblies. There is a need for a more widely adaptable push/pull door latch handles designed for converting a wide variety of conventional knob or lever latches.

SUMMARY

This and other problems of conventional push/pull door handle assemblies are addressed by the present door handle assembly. A cam with a general bow tie profile in combination with a contoured finger-like cam lever provides improved efficiency and ease of operation of a push-pull door handle and latch assembly. Further, to better accommodate a wide variety of pre-existing latching mechanisms in doors that are converted to push/pull door handles from other configurations, the present assembly is mountable in many positions. In a preferred embodiment, a working end of the door handle is provided with an adapter plate having a plurality of mounting holes. The cam lever is attachable to the adapter plate in a variety of positions and orientations to facilitate conversion of door latch assemblies to the push-pull type. Another feature of the present door handle assembly is a stop used to limit the travel of the handle by engaging the cam lever on the return stroke. This stop has been found to improve the touch and feel of the present handle.

In one embodiment, a door handle assembly for use with a door is provided with a base plate, a door handle having a working end pivotally connected to the base plate and a free end opposite of the working end configured for manipulation by an operator. An adapter plate mounted on the working end of the door handle and a cam lever are also included in the present door handle assembly. A securable end of the cam lever is affixable to the adapter plate, and a free end of the cam lever is configured for engagement with a cam, for activating a door latch assembly.

An example of the present push-pull door handle is a paddle-style handle that includes a free end configured for manipulation by an operator, a working end (opposite of the free end) having a pair of spaced, forwardly projecting ears, and a plurality of recessed spaces located between the ears. Partitions are provided to separate recessed spaces. Ears facilitate, by being constructed and arranged appropriately, pivotally mounting the door handle to the base plate.

Another embodiment of the present door handle assembly for use with a door includes the features described above, and is further provided with a cam. The cam lever is configured for engagement with the cam, causing the cam to rotate coaxially about an axis. A pair of diametrically opposed, generally triangular lobes provide the present cam with a general bow-tie shape, and an opening between the lobes provides engagement with at least one driveshaft.

DETAILED DESCRIPTION

Figure 1:
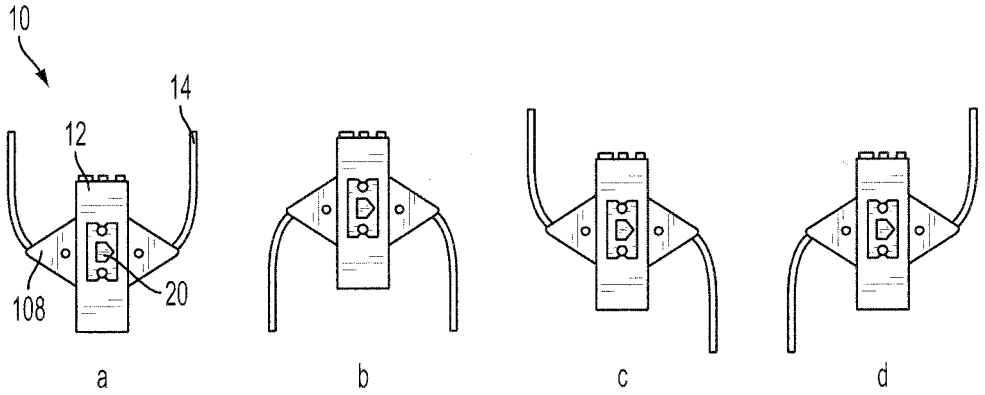
FIGS. 1*a*-1*d* show several elevational side views of assembled door latches with the present door handles in various vertically aligned positions.
Figure 2:
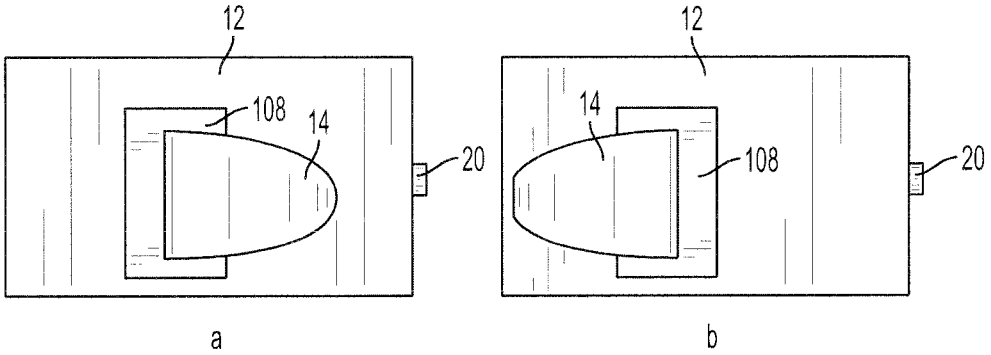
FIGS. 2*a* - 2*b* depict frontal views of the present push/pull door latches with door handles in different horizontally aligned positions.
Figure 3:
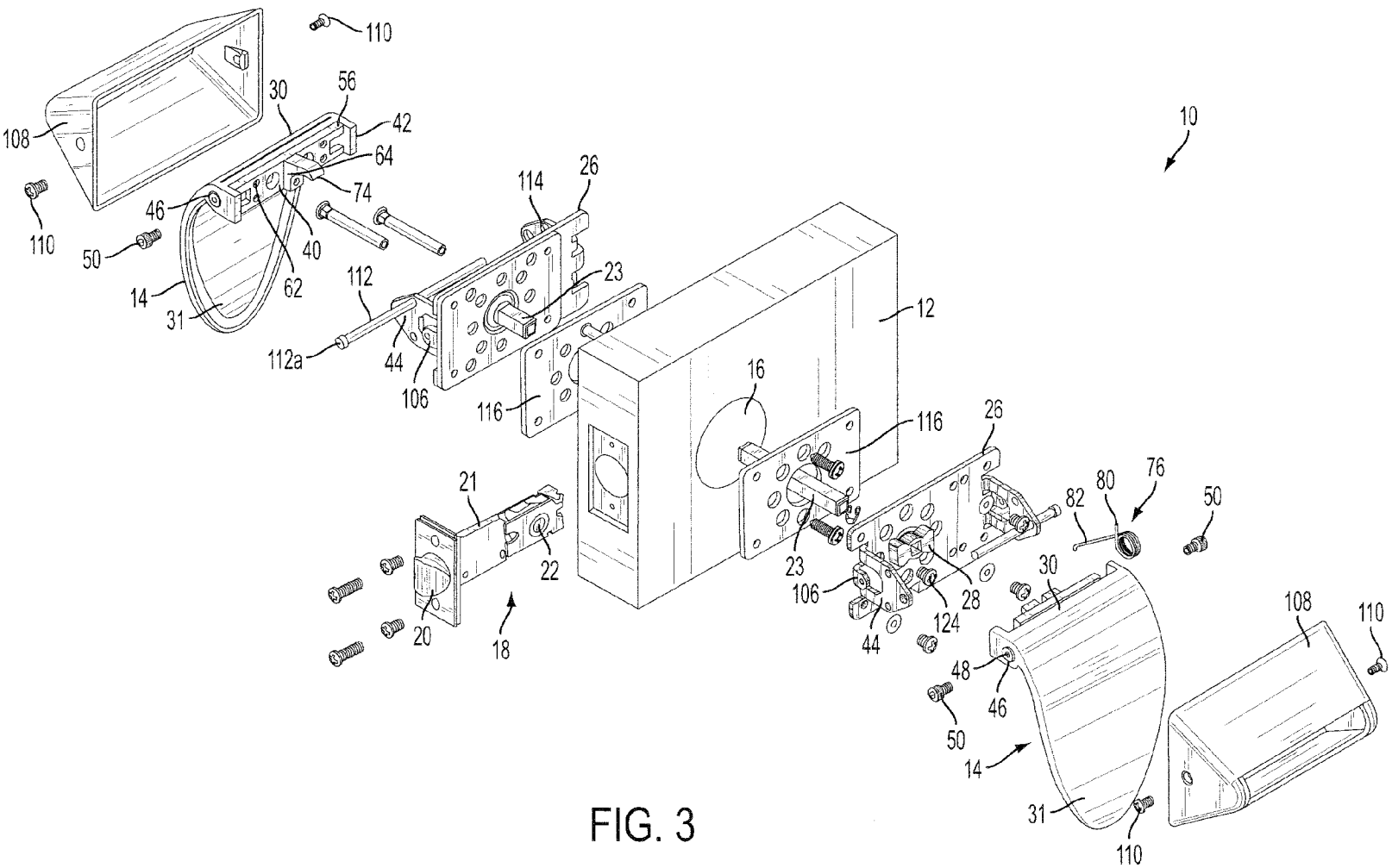
FIG. 3 is an exploded top perspective view of an embodiment of the present door latch assembly.

Referring now to FIGS. 1-3, a door handle assembly is generally designated 10 and is configured for use with a door 12. As shown in FIGS. 1*a*-1*d*, a paddle-style push/pull door handle 14 may optionally be vertically aligned in various positions including both up (a), both down (b) or one up and one down (c and d). FIG. 2 shows door handles 14 horizontally aligned and optionally oriented to the left (a) or the right (b).

Figure 12:
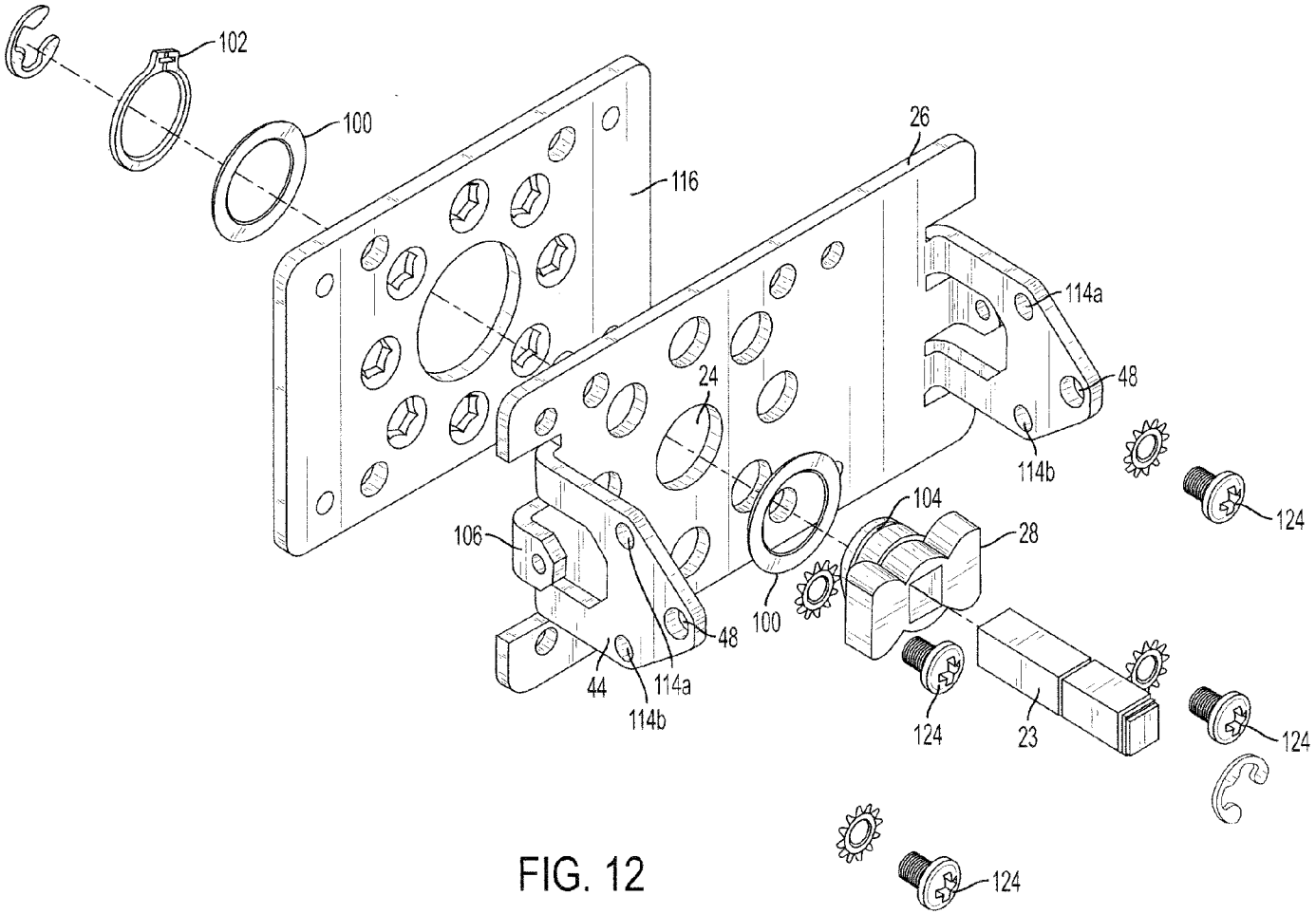
FIG. 12 is an exploded top perspective view of the present cam and base plate assembly.
Figure 13:
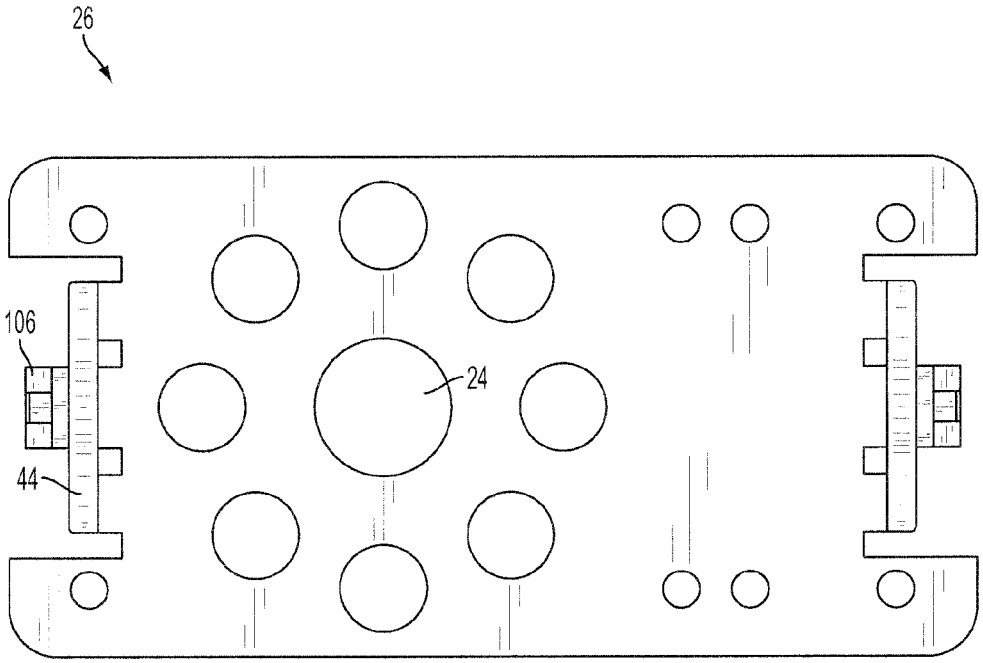
FIG. 13 is a front elevation view of the present base plate.

FIG. 3 depicts an exploded view of the door handle assembly 10 shown in FIG. 1(*b*) with both handles 14 down. The door 12, shown fragmentarily, has a mounting hole 16 through which a conventional locking mechanism 18 is installed. As is known in the art, the locking mechanism 18 includes a biased locking bolt 20 retractable through rotation of a latch member 21 having a throughbore 22. The throughbore engages with a driveshaft 23 extending through an aperture 24 (FIG. 12) in a base plate 26. Axial rotation of the driveshaft 23, caused by an operator moving (pushing or pulling) the present handle 14, actuates the locking bolt 20. At at least one end, the driveshaft 23 also engages a cam 28 that is associated with the base plate 26, as described below.

Rotation of the cam 28 occurs in response to the above-identified push or pull movement of the door handle 14. In one embodiment of the present door handle assembly 10, the door handle 14 has a working end 30 that is pivotally connected to the base plate 26, and an opposite free end 31 that is configured for manipulation, such as pushing or pulling by an operator. Rotation of the cam 28 as a result of this pushing or pulling the door handle 14 will be described below.

While a pair of the present door handles 14*b* is depicted in FIG. 3 and described below, it is contemplated that the present door handle assembly is also applicable to door handles in configurations shown at 14*a, c* and *d* (FIGS. 1 and 2).

Figure 4:
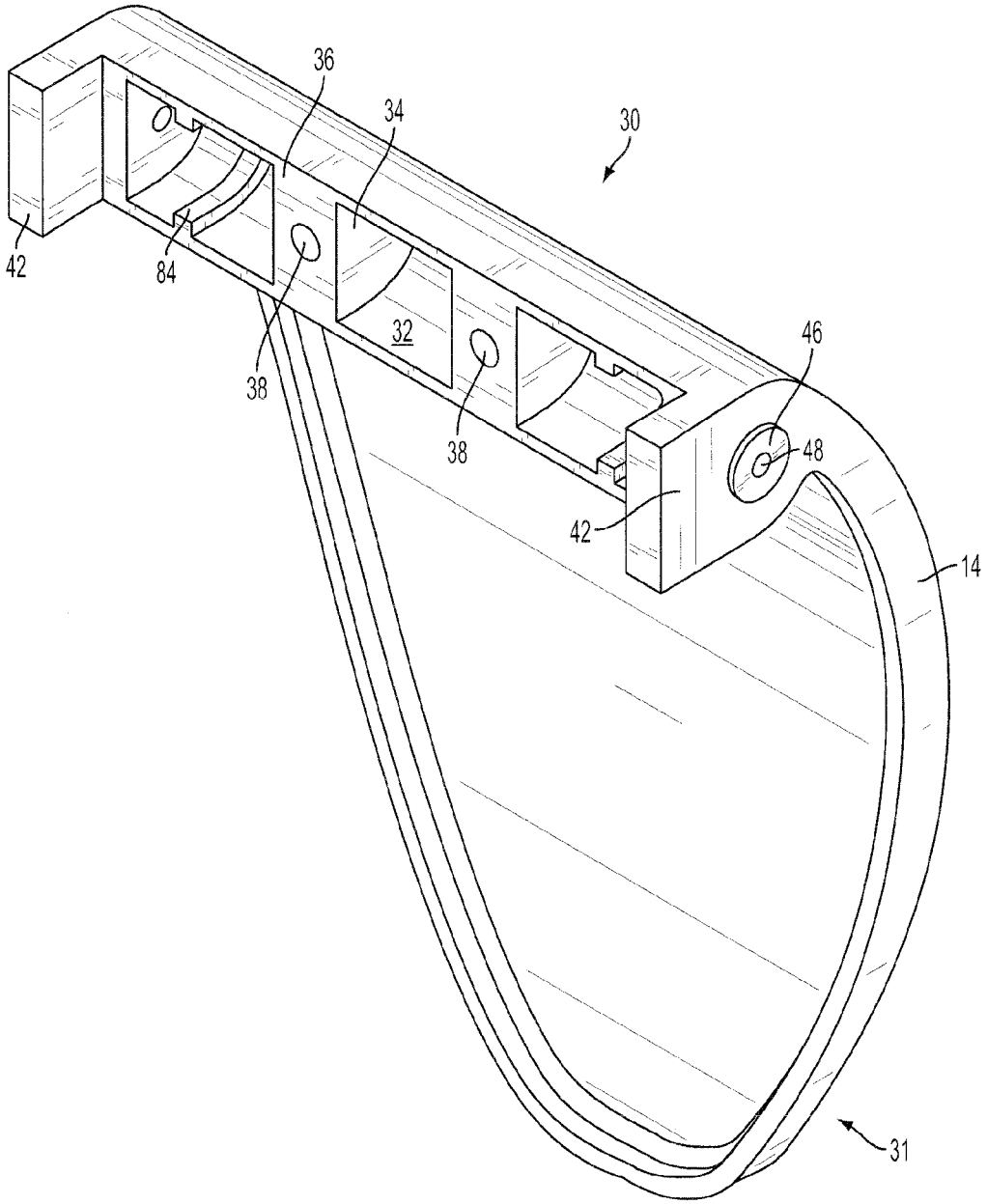
FIG. 4 is a top perspective view of the present door handle.
Figure 14:
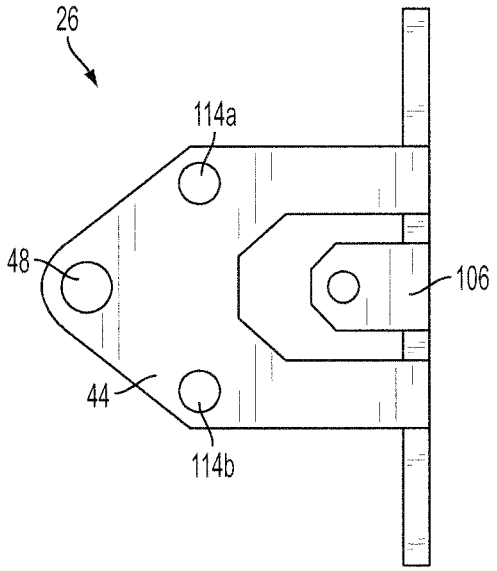
FIG. 14 is an enlarged side elevation view of the base plate of FIGS. 12 and 13.

Referring to FIG. 4, an example of the present door handle 14 includes a plurality of recessed spaces 32 on the working end 30. Generally vertically oriented, spaced, parallel partitions 34 define and separate the recessed spaces 32 while also providing a surface or face 36 for mounting other components of the door handle assembly 10, described below. In one embodiment, there are three recessed spaces 32 linearly and laterally spaced across the working end 30. Each partition 34 is provided with at least one mounting hole 38 on its face 36, and an adapter plate 40 (FIGS. 3 and 5) is attached to the working end 30, preferably with threaded fasteners. Referring now to FIGS. 3, 4, 14 and 16, also included on the working end 30 is a pair of spaced, and forwardly projecting ears 42 that extend away from the free end beyond the faces 36 of the partitions 34. The ears 42 are constructed and arranged for pivotally engaging the base plate 26 at a first pair of spaced tabs 44 (FIGS. 3 and 14). At least one of the ears 42 and/or the first pair of tabs 44 is provided with a raised formation 46 surrounding an opening 48 through which a fastener 50 (FIG. 3) is inserted to rotatably connect the base plate 26 and the door handle 14. In a preferred embodiment, the fasteners 50 act like ball bearings, allowing easy movement of the door handle 14 relative to the base plate 26. In this embodiment, the raised formation 46 is configured for reducing frictional resistance to rotation between the ears 42 on the working end 30 of the present door handle 14 and the first pair of tabs 44 on the base plate 26, thus facilitating pivoting of the handle 14 around the point of attachment, defined by the fasteners 50.

Figure 5:
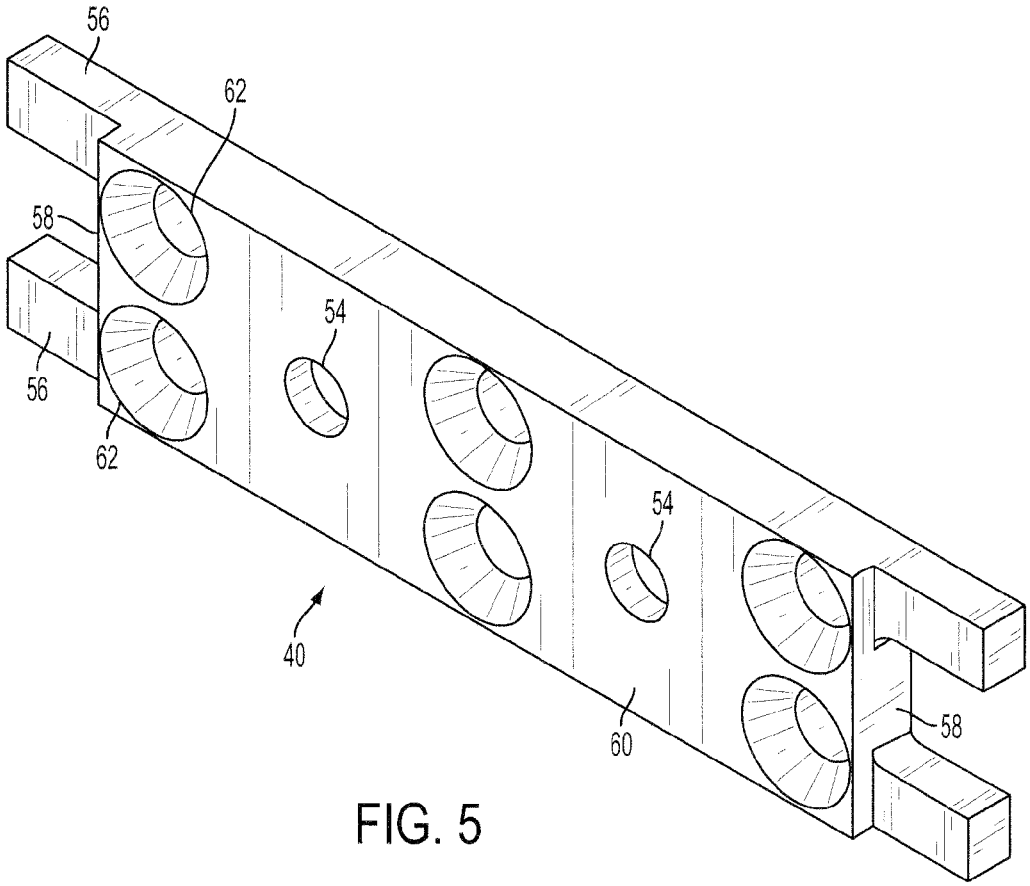
FIG. 5 is a top rear perspective view of the present adapter plate.
Figure 17:
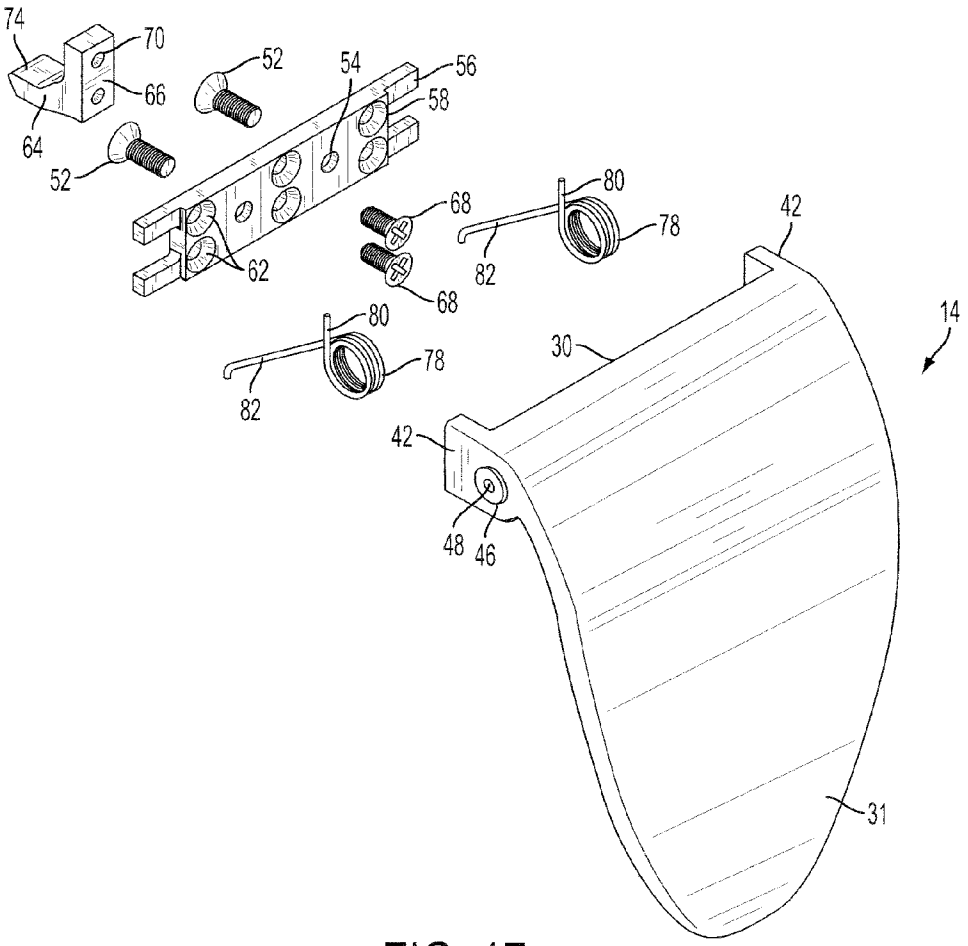
FIG. 17 is an exploded perspective view of the present push handle.
Figure 18:
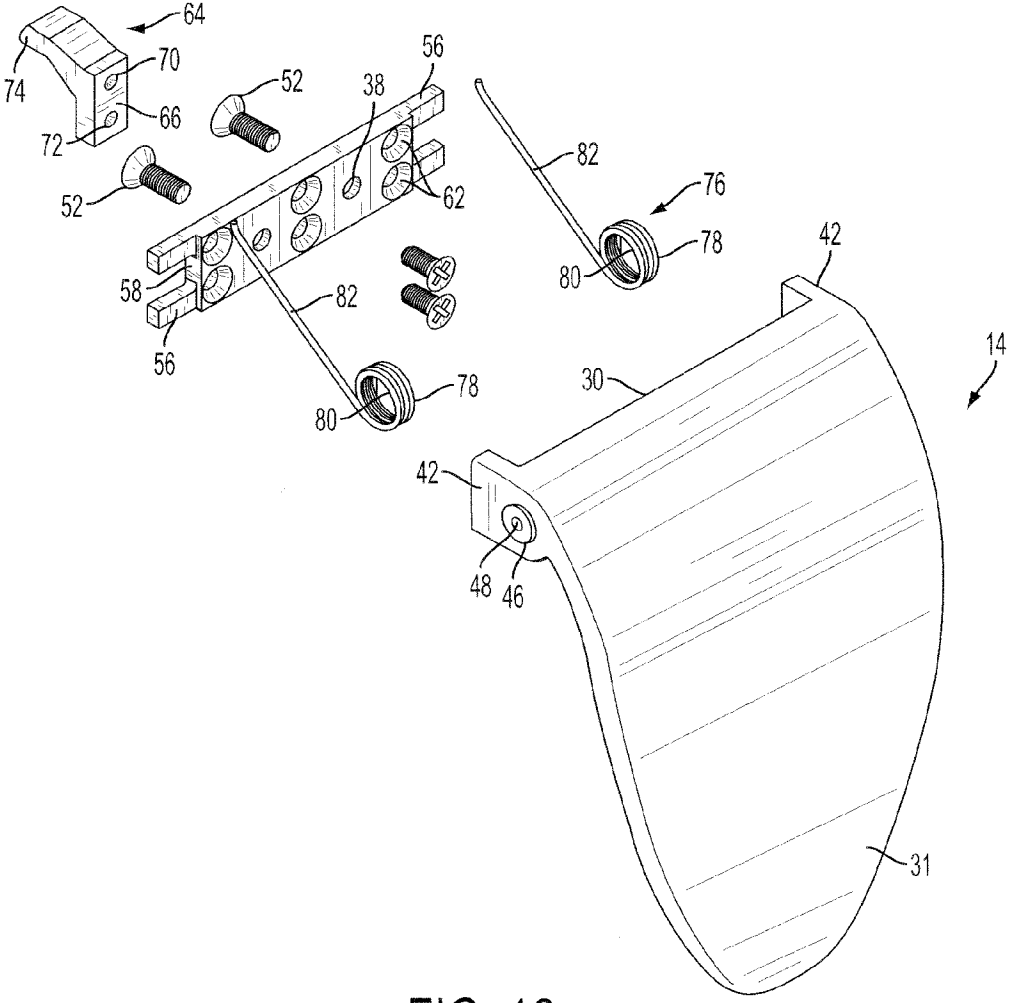
FIG. 18 is an exploded perspective view of another embodiment of the present pull handle.

Referring to FIGS. 5, 17 and 18, the adapter plate 40 Is provided with fasteners 52 (FIGS. 17, 18), such as threaded screws or the like, to secure the plate 40 to the handle 14 by engaging the mounting holes 38 on the partition 34, as described above, through corresponding throughbores 54 on the plate. At least one generally co-planar arm 56 projects laterally from each end 58 of the adapter plate 40. In the preferred embodiment, a pair of laterally extending arms 56 at each end 58 facilitates engagement of the adapter plate 40 at the working end 30 of the door handle 14. These arms 56 are spaced apart by a height that is less than a center portion 60 of the adapter plate, and have a width that is less than the center portion. Besides the throughbores 54, an embodiment of the adapter plate 40 has at least one pair of vertically aligned holes 62, with the pairs being spaced across the width of the plate. The holes 62 allow attachment of other components of the door handle assembly 10, as described below.

Figure 8:
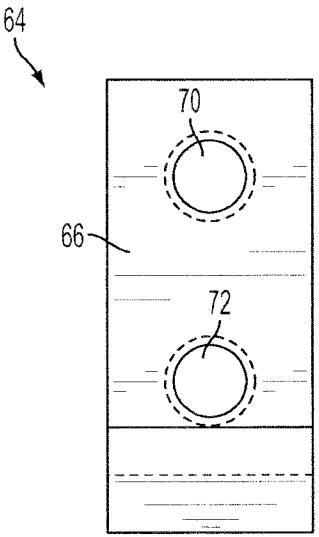
FIG. 8 is a rear elevation view of the cam lever of FIG. 6.

Referring now to FIGS. 3 and 6-8, further provided in the present assembly 10 is a cam lever 64 with a securable end 66 affixable to the adapter plate 40, preferably in selected pairs of holes 62. Desirably, the pairs of holes 62 include a left, center and right pair, thereby providing optional points of attachment for the cam lever 64. Fasteners 68 (FIG. 3) secure the securable end 66 of the cam lever 64 at the holes 62, through a throughbore 70 and a blind end bore 72, both of which are preferably threaded (FIG. 8). The holes 62 are counter sunk so that upon assembly, heads of the fasteners 68 securing the cam lever 64 to the plate 40 are flush with the partition face 36. A free end 74 (FIGS. 6, 7) of the cam lever 64 is configured for engagement with the cam 28, as described in further detail below, for activating the door latch assembly (FIG. 3) by causing the cam to rotate coaxially with the driveshaft 23, which retracts the locking bolt 20, resulting in opening of the door 12.

Figure 7:
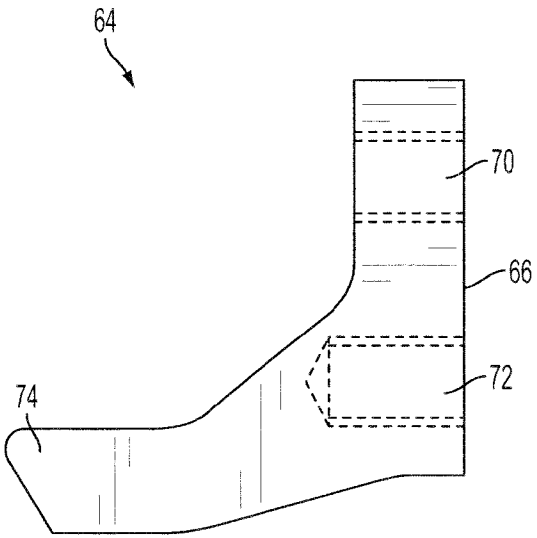
FIG. 7 is a side elevation view of the cam lever of FIG. 6.
Figure 6:
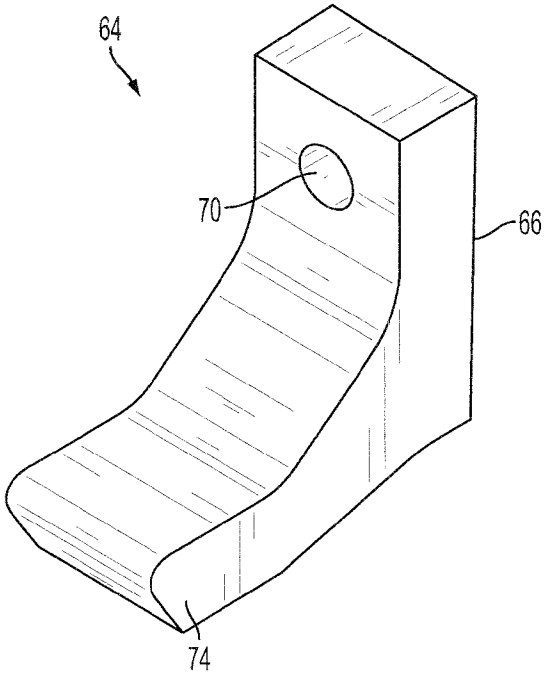
FIG. 6 is a top perspective view of the present cam lever.

As seen in FIGS. 6, 7 and 8, the present cam lever 64 is generally "L" shaped when viewed from the side, such that the free end 74 forms a finger that projects normally from a plane defined by the mounting end 66. Engagement of the lever 64 with the cam 28 occurs when the door handle 14 is pushed or pulled, as previously described. Through action of the lever 64 on the cam 28, pivoting, push/pull motion of the door handle 14 is transferred to rotational motion of the driveshaft 23. As is well known in the art, the axis of rotation of the handle 14 is transverse to the axis of the drive shaft 23. Depending on the application, it is contemplated that more than one cam lever 64 is optionally attached to the adapter plate 40. Also, it is contemplated that the cam lever 64 is attachable at more than one place, either right, left or center, on the adapter plate 40. It is further contemplated that there may be more than one driveshaft 23, for example in an embodiment providing one, relatively shorter driveshaft controlled by the handle 14 on the interior of the door 12, and a second, relatively shorter driveshaft controlled by the handle on the exterior of the door.

Figure 9:
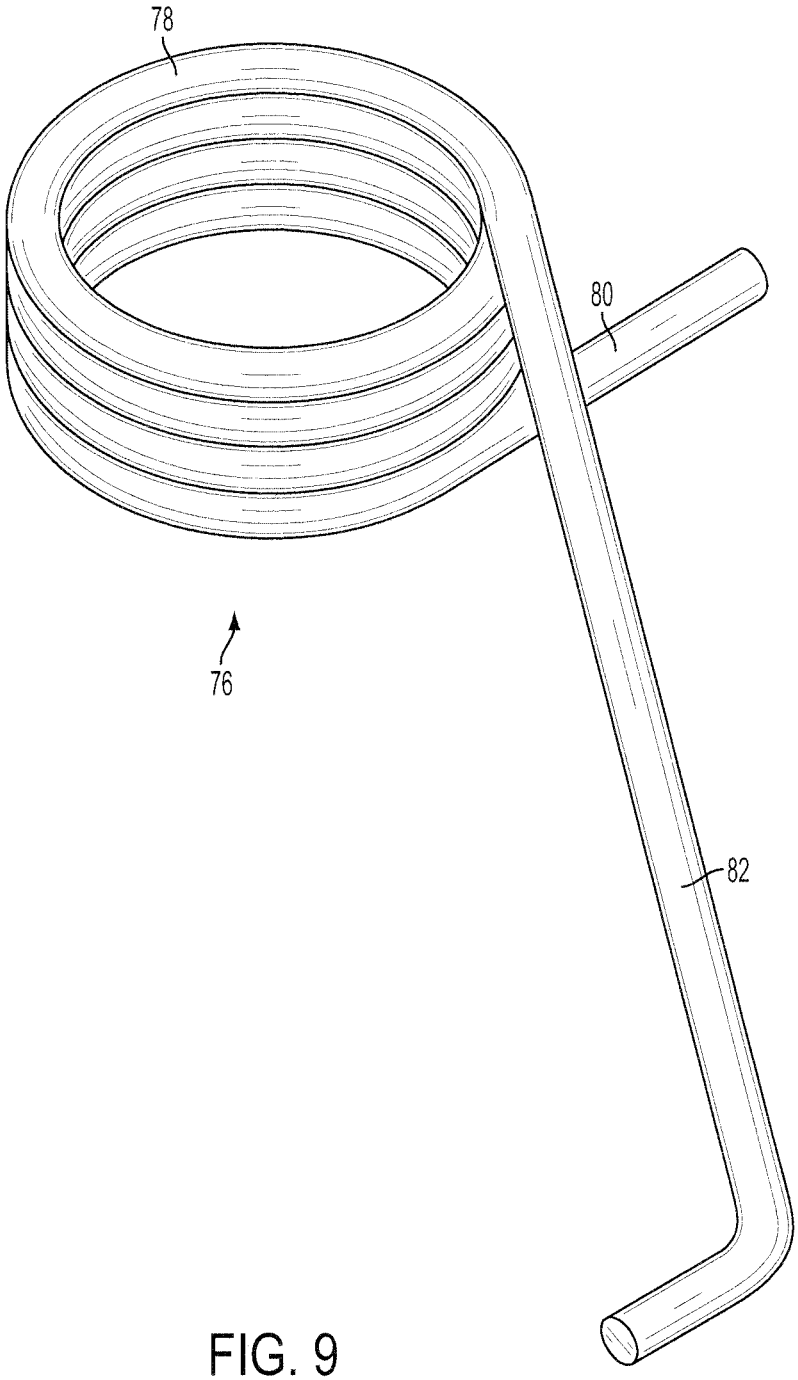
FIG. 9 is a top perspective view of the spring of FIG. 3.
Figure 10:
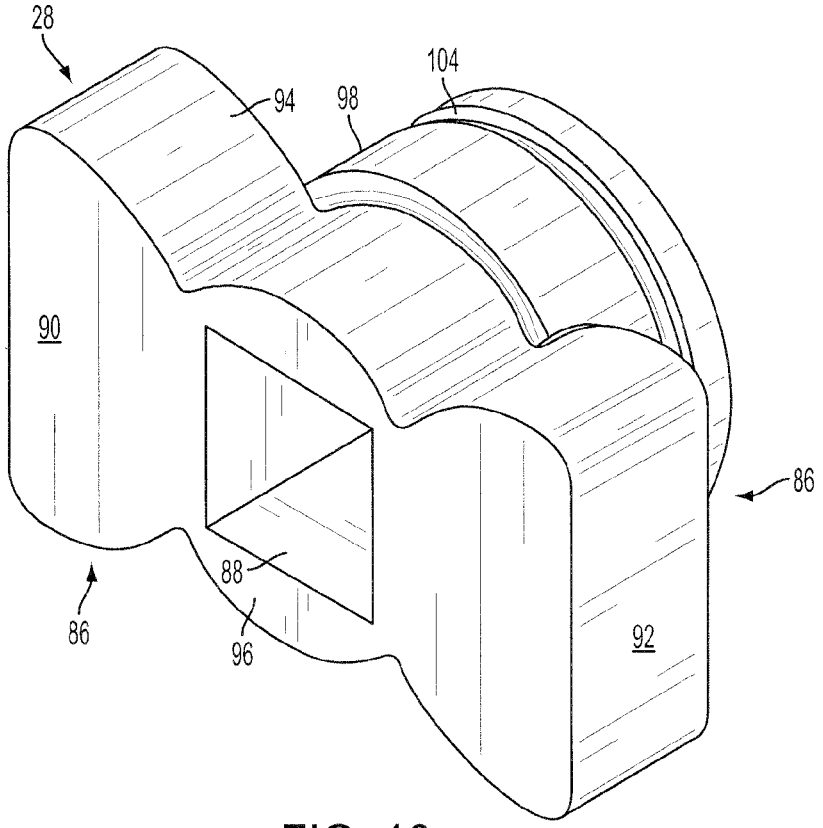
FIG. 10 is a top perspective view of the present cam.
Figure 11:
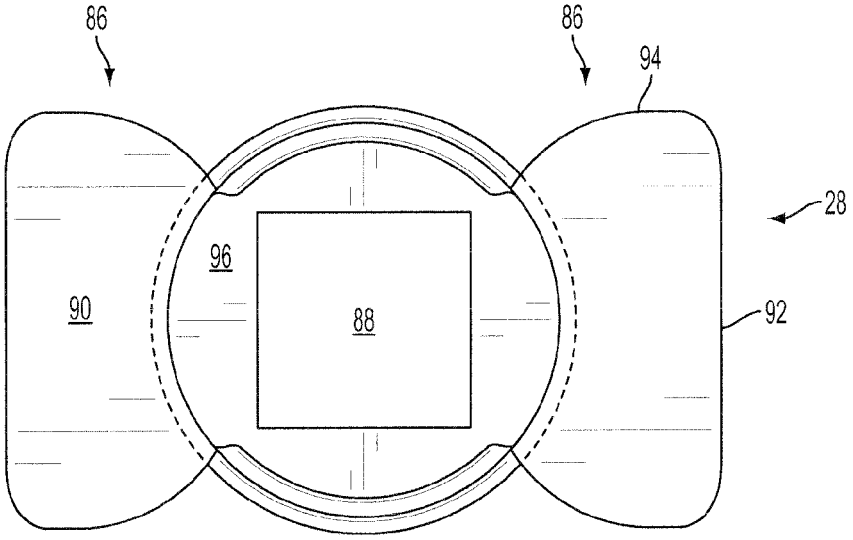
FIG. 11 is a front elevation view of the cam of FIG. 10.

An advantageous feature of the present door handle assembly 10 is that the cam lever 64 is attachable to the adapter plate 40 in a "finger up" or "finger down" (FIGS. 3, 17 and 18) position. This adjustability facilitates the mounting of the handle 14 in the pointing down position of 14*a* and the pointing up position of 14*b*, as needed. In addition, to accommodate a variety of conventional lock assemblies, the cam lever 64 is mountable to any of the selected holes 62 of the adapter plate 44, as needed for a variety of retrofitting scenarios. Referring now to FIGS. 3, 4 and 9, in the present latch assembly 10, the recessed spaces 32 and associated partitions 34 are configured for accommodating a return spring 76. Preferably, the spring 76 is provided with a central, circular, coiled portion 78 dimensioned for being positioned in one of the recessed spaces 32, and having straight portions 80, 82 extending from each end. When viewed from above, the spring 76 has a general "V" shape with the circular, coil 78 at the center of the "V". By action of the spring 76, the handle 14 returns to a neutral position after it is pushed or pulled. Tension provided by the spring 76 is significant and improves the overall feel of the door handle assembly 10 when in operation by reducing excess wiggling or rattling of components. Optionally, two springs 76, one in each of the two end spaces 32, are placed in the handle 14. In this embodiment, the center space 32 also provides an improvement in the overall feel of the door handle 14 by reducing the weight of the handle. Optionally, at least one of the recessed spaces 32 includes a curved, "c" shaped ridge 84 for orienting and further securing the spring 76 in the space.

Referring to FIGS. 3, and 10-12, the cam 28 is provided with a pair of diametrically opposed, generally triangular lobes 86, and an opening 88 between the lobes for engaging the driveshaft 23. In this example embodiment, each lobe 86 of the present cam 28 is provided with a generally parallel face 90 extending perpendicular to the axis, a generally planar end portion 92 and a pair of upper and lower curved portions 94 emanating from a central area 96 on each side of the opening 88 and terminating in the end portions 92. The planar end portions 92 are parallel to each other, and curved portions 94 are configured for receiving the free end 74 of the cam lever 64. A ratio of stroke to travel is known in the art to describe how far one must push the door handle 14 to disengage the locking bolt 20. Improvement of this ratio in the present door handle assembly 10 is attributable, at least in part, to the generally bow-tie shaped profile of the present cam 28. Convex curved surfaces 94 allow the cam lever 64 to smoothly travel along the lobe, depending on selection of the cam lever position on the adapter plate 40 and selection of the position of the door handle 14 relative to the base plate 26. Preferably, the curved surfaces 94 are arcuate or semi-circular in shape. Also included on the cam 28 is a pin 98 (best seen in FIG. 10), constructed and arranged for extending through the aperture 24 in the base plate 26. Retention of the cam 28 in the base plate 26, so that the cam is securely held in place, yet remains free to rotate, is accomplished with a washer 100 (FIG. 12) and a clip-like retaining ring 102 engaging a corresponding groove 104 around the pin 98. Heat treatable, high carbon steel or suitable alloy is a preferred material for manufacturing the cam 28, preferably by investment casting methods which are known in the art. Other known production techniques are contemplated.

Referring now to FIGS. 3, and 12-14, a preferred association of the cam 28 to the base plate 26 is shown. The base plate 26 is mounted to the door 12, can assume a variety of positions, and remains coplanar with the surface of the door 12 upon installation of the present door handle assembly 10 in any contemplated configuration. A second set of tabs, called cover tabs 106, are provided on the base plate 26 for attaching a cover 108 to conceal the door latch components, but not the handles 14, especially the free end 31. A set of threaded fasteners 110 (FIG. 3) secure the cover 104 in place.

Figure 15:
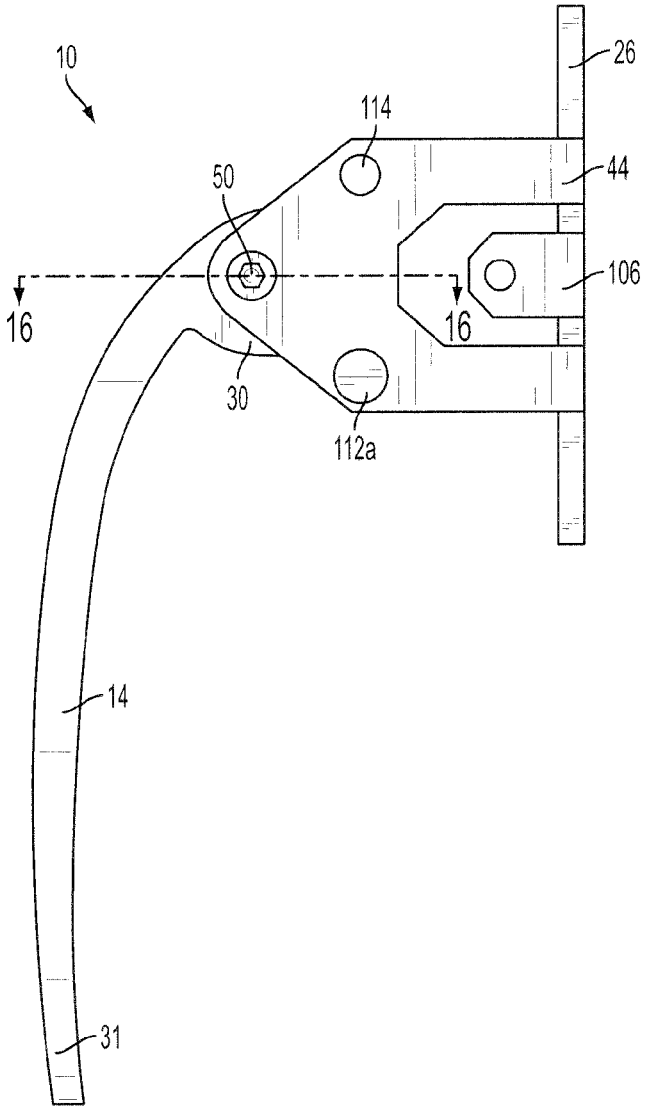
FIG. 15 is a side elevation view of the present door handle assembly.
Figure 16:
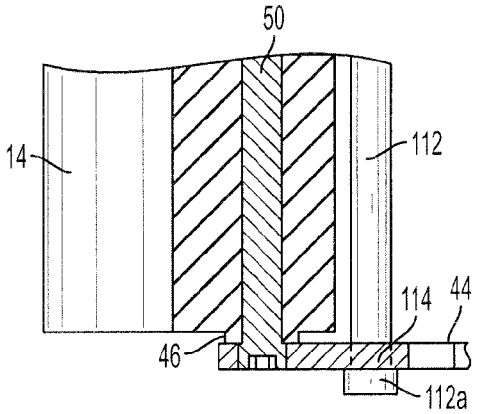
FIG. 16 is a partial cross sectional view taken along the line 16-16 and in the direction generally indicated of FIG. 15.

Referring to FIGS. 15 and 16, the door handle assembly 10, as described above, includes the door handle 14 pivotally connected to the base plate 26, at the first pair of tabs 44 (one tab is shown). Also included in the door handle assembly 10, a stop or throughpin 112 (FIG. 16) extends through a pair of holes 114 (one shown) in the first tabs 44 of the base plate 26, and the throughpin 112 is positioned in either one of two sets of holes 114*a* or 114*b* (FIG. 14), depending on the orientation of the door handle 14 relative to the base plate 26. During a return stroke of the handles 14, the return spring 76 pushes the handle, the adapter plate 40 and the cam lever 64 backward until the cam lever contacts the throughpin 112. Contact of the cam lever 64 (FIG. 3), particularly the free end 74, with the throughpin 112 during an operational pivot stroke of the door handle 14, the assembly 10 thus provides a stop for the handle as it pivots around the points 50.

Advantageously, the throughpin 112 contributes to a generally pleasing touch and feel by reducing slack, sloppiness or looseness in the assembly 10. It is conceived that the throughpin 112 may take other forms, may not be a pin, and is held in place by any means known in the art. For example, the throughpin 112 with a head 112*a* at one end is held in place by attaching a retaining clip (not shown) at the other end after the throughpin is inserted through the holes 114*a* or 114*b*. Alternatively, the throughpin 112 is threaded into a selected hole 114*a* or 114*b*.

Referring to FIGS. 17 and 18, the handle 14 is easily converted from a push configuration to a pull configuration by arranging the spring 76, or springs, and the cam lever 64. FIG. 17 depicts an example of a push handle 14 with two return springs 76, one in each recessed space 32 near the ears 42 of the working end of the handle 14. In a push configuration, the cam lever 64 is configured to strike the cam 28 when the operator pushes on the free end 31 of the handle 14. Also, the springs 76 are configured and arranged to cause the handle to return to a neutral position after the push. FIG. 18 depicts a pull handle, with the cam lever 64 and springs 76 arranged oppositely to the push handle. Further, it is contemplated that the base 26 and adapter 44 plates allow for alternate configurations of the cam lever 64 to strike and/or engage the cam 28 from door handles that are positioned sideways, as shown in FIGS. 1 and 2.

Referring again to FIGS. 3 and 12, another advantageous feature of the present door handle assembly 10 is that the base plate 26 is securable to a conventional lock plate 116 having an opening 118 for accommodating the drive shaft 23. The lock plate 116 is provided with a plurality of mounting openings 120 that are dispersed around the opening 118 in registry with a similar plurality of openings 122 on the base plate 26. A suitable lock plate 116 is disclosed in U.S. Pat. No. 5,730,478, which is incorporated by reference. Using fasteners 124, the base plate 26 is fastened to the lock plate 116, and ultimately onto the door 12, in a variety of optional orientations to be able to obtain the various handle orientations depicted in FIGS. 1*a-d* and FIGS. 2*a-b*. Also, it should be noted that the aperture 24 in the base plate 26 is not necessarily centered. However, the registry of the respective openings 120, 122 maintains proper engagement of the present assembly 10, particularly the cam 28, with the drive shaft 23 regardless of the orientation of the handles 14*a*, 14*b*.

While particular embodiments of the present door handle assembly have been described herein, it will be appreciated by those skilled in the art that changes and modifications may be made without departing from the invention in its broader aspects and as set forth in the following claims.

The invention claimed is:

1. A door handle assembly for use with a door, comprising:

a base plate;

a door handle having a working end pivotally connected to said base plate and a free end opposite of said working end configured for manipulation by an operator;

an adapter plate mounted on said working end of said door handle, said adapter plate including opposing ends and at least one generally co-planar arm projecting laterally from each of said ends; and an integral cam lever with a securable end removably connected to said adapter plate in multiple distinct positions and in multiple orientations relative to said adapter plate, and a free end configured for engagement with a cam for activating a door latch assembly based on the position of said cam lever.

2. The door handle assembly of claim 1 wherein said working end has a pair of spaced, forwardly projecting ears constructed and arranged for pivotally engaging said base plate, said base plate having a first pair of spaced tabs positioned for rotatably supporting said ears, and at least one of said pair of ears and said first pair of tabs is provided with a raised formation surrounding an opening through which a fastener is inserted, said raised formation configured for rotatably spacing said working end of said door handle from said tabs of said base plate.

3. The door handle assembly of claim 1, wherein said working end includes a plurality of recessed spaces between a pair of spaced, forwardly projecting ears and divided by partitions, said adapter plate attached to said working end at said partitions.

4. The door handle assembly of claim 3, wherein at least one of said recessed space and partition is configured for accommodating a return spring.

5. The door handle assembly of claim 1, further including two of said co-planar arms projecting from each end, said arms at each said end being spaced apart by a height that is less than a height of a center portion of said adapter plate.

6. The door handle assembly of claim 1, further comprising a throughpin extending through a pair of holes in a first pair of tabs of said base plate, said cam lever contacting said pin during an operational pivot stroke of said door handle to provide a stop for said handle during an operational pivot stroke.

7. The door handle assembly of claim 1, further comprising a cover attachable to a pair of cover tabs of said base plate.

8. A push-pull door handle, comprising:

a free end configured for manipulation by an operator;

a working end opposite said free end and having a pair of spaced, forwardly projecting ears, a space located between said ears, said ears constructed and arranged for being pivotally mounted to a base plate;

an adapter plate non-movably positioned in said space and secured between said ears, and including multiple distinct mounting positions, said adapter plate extending in a single plane and including an arm projecting laterally from each end of said adapter plate, wherein an entire length of each said arm lies in said plane; and at least one cam lever with a securable end fixedly connected to said adapter plate in different orientations at each of said multiple distinct mounting positions relative to said adapter plate, and a free end configured for engagement with a cam for activating a door latch assembly based on the position of said cam lever.

9. The door handle of claim 8, wherein each ear of said pair of ears further comprises a raised area surrounding a fastener receiving hole, said raised area configured for rotatably spacing said working end of said door handle from said base plate.

10. The door handle of claim 8, wherein at least one of said recessed spaces further comprises a partition configured for aligning a spring that assists with returning said door handle to a neutral position.

11. A door handle assembly for use with a door, comprising:

a base plate;

a door handle movably connected to said base plate;

an adapter plate mounted to said door handle and including multiple pairs of mounting holes; and a cam lever with a securable end removably connected to each of said pairs of mounting holes on said adapter plate in a first position and an opposing, second position, and in multiple orientations relative to said adapter plate, and a free end configured for engagement with a cam, causing said cam to rotate coaxially about an axis in a first rotational direction when said cam lever is in said first position and in a second rotational direction when said cam lever is in said second position, said cam is provided with a pair of diametrically opposed, generally triangular lobes, and an opening between said lobes for engaging at least one driveshaft.

12. The door handle assembly of claim 11, wherein said cam has two generally parallel faces perpendicular to said axis, with two generally parallel and planar end portions and four curved portions emanating from a central area on each side of said central opening and terminating in said end portions, the curved portions configured for receiving said free end of said cam lever.

13. The door handle assembly of claim 11 wherein said cam further comprises a pin for extending through an aperture in the base plate, with a washer and a retaining ring around said pin for retaining said cam in the base plate such that said cam is securely held in place, yet free to rotate.

14. A door handle assembly for use with a door, comprising:

a base plate;

a door handle having a working end pivotally connected to said base plate and a free end opposite of said working end configured for manipulation by an operator;

an adapter plate mounted on said working end of said door handle, wherein said adapter plate comprises multiple pairs of vertically disposed holes positioned across a width of said adapter plate, wherein said multiple holes are configured for affixing said cam lever in at least one of said holes; and an integral cam lever with a securable end removably connected to one of said multiple pairs of holes of said adapter plate and in multiple orientations relative to said adapter plate, and a free end configured for engagement with a cam for activating a door latch assembly based on the position of said cam lever.

15. The door handle assembly of claim 13, wherein said pairs of holes include a left pair, a center pair and a right pair of holes.

* * * * *